US008739329B2

(12) United States Patent
Koorey

(10) Patent No.: US 8,739,329 B2
(45) Date of Patent: Jun. 3, 2014

(54) BED LIFTING APPARATUS

(75) Inventor: John Koorey, Manly (AU)

(73) Assignee: Griffith Hack, Sydney, NSW (AU)

( * ) Notice: Subject to any disclaimer, the term of this patent is extended or adjusted under 35 U.S.C. 154(b) by 0 days.

(21) Appl. No.: 13/878,951

(22) PCT Filed: Oct. 13, 2011

(86) PCT No.: PCT/AU2011/001307

§ 371 (c)(1),
(2), (4) Date: Jul. 23, 2013

(87) PCT Pub. No.: WO2012/048378

PCT Pub. Date: Apr. 19, 2012

(65) Prior Publication Data

US 2013/0291309 A1 Nov. 7, 2013

(30) Foreign Application Priority Data

Oct. 15, 2010 (AU) ..... 2010904612
Jul. 28, 2011 (AU) ..... 2011903021

(51) Int. Cl.
*A47C 31/00* (2006.01)
*A47C 19/04* (2006.01)

(52) U.S. Cl.
USPC ..... 5/11; 5/488; 5/509.1; 5/207

(58) Field of Classification Search
USPC ..... 5/11, 611, 488, 509.1, 21, 207–209, 5/181, 185
See application file for complete search history.

(56) References Cited

U.S. PATENT DOCUMENTS

| | | | | |
|---|---|---|---|---|
| 3,887,950 | A * | 6/1975 | Wachsman | 5/11 |
| 5,490,298 | A * | 2/1996 | Goldsmith et al. | 5/611 |
| 5,594,961 | A * | 1/1997 | Yokoi et al. | 5/11 |
| 5,758,372 | A * | 6/1998 | Lopez Diaz | 5/200.1 |
| 6,941,594 | B1 * | 9/2005 | Mosley | 5/11 |
| 7,743,440 | B2 * | 6/2010 | Burnett | 5/11 |
| 7,757,313 | B2 * | 7/2010 | Koorey | 5/11 |
| 7,941,879 | B2 * | 5/2011 | Burnett | 5/11 |
| 2005/0251915 | A1 * | 11/2005 | Elizondo | 5/611 |
| 2005/0251916 | A1 * | 11/2005 | Elizondo | 5/611 |
| 2007/0283494 | A1 * | 12/2007 | Vasey | 5/488 |

* cited by examiner

*Primary Examiner* — Michael Trettel
(74) *Attorney, Agent, or Firm* — Ballard Spahr LLP

(57) ABSTRACT

A bed lifting apparatus comprising a base and a support frame connected by at least one linkage arm, the at least one linkage arm including at least one biasing arrangement arranged to maintain the base and the support frame in a spaced apart relationship, wherein, in use, when a bed is located on the support frame, the bed is maintained in a spaced apart relationship from a floor surface.

26 Claims, 13 Drawing Sheets

BED LIFTING APPARATUS

CROSS REFERENCE TO RELATED APPLICATIONS

The present application is a National Phase Application of International Application No. PCT/AU2011/001307, filed Oct. 13, 2011, which claims priority to Australian Patent Application No. 2010904612, filed Oct. 15, 2010, and Australian Patent Application No. 2011903021, filed Jul. 28, 2011, which applications are incorporated herein fully by this reference.

TECHNICAL FIELD

The present invention relates to a bed lifting apparatus and, particularly, although not exclusively, to a bed lifting apparatus including a biasing arrangement.

BACKGROUND

The preparation of a bed is a common and necessary task for many domestic and commercial circumstances. Workers employed to prepare beds usually undertake the steps of cleaning of areas beneath the bed to remove any debris or waste, followed by the replacement of bed sheets or other bed fixtures. In performing these steps, the worker may be required to lower his or her body into an awkward and uncomfortable position to access the areas beneath the bed or to properly access the underside of the bed to replace bed sheets or other fixtures.

In light of these awkward positions, workers employed to prepare beds may be subjected to an increase risk of injury, including back injuries. In situations such as hotels, camps or hospitals where there are many beds which must be prepared, the risk of injury increases as the number of beds increase whilst also reducing the efficiency at which a worker can prepare the bed.

SUMMARY OF THE INVENTION

In accordance with a first aspect of the present invention, there is provided a bed lifting apparatus comprising a base and a support frame connected by at least one linkage arm, the at least one linkage arm including at least one biasing arrangement arranged to maintain the base and the support frame in a spaced apart relationship, wherein, in use, when a bed is located on the support frame, the bed is maintained in a spaced apart relationship from a floor surface.

In an embodiment of the first aspect, the support frame is arranged to move into a proximal relationship with the base when a force is applied in opposition to the biasing arrangement.

In an embodiment of the first aspect, wherein movement is effected when the force is applied on the bed or support frame in a direction towards the base.

In an embodiment of the first aspect, the apparatus further comprises a locking arrangement arranged to lock the support frame in the proximal relationship with the base.

In an embodiment of the first aspect, the locking arrangement is disposed on the base.

In an embodiment of the first aspect, the locking arrangement is arranged to penetrate an aperture of the support frame to lock the support frame with the base.

In an embodiment of the first aspect, the locking arrangement is in communication with an actuator arranged to extend the locking arrangement into and retract the locking arrangement from the aperture of the support frame.

In an embodiment of the first aspect, the actuator includes a foot operated switch.

In an embodiment of the first aspect, the biasing arrangement is arranged to cooperate with the at least one linkage arm to maintain the support frame in a spaced apart relationship with the base.

In an embodiment of the first aspect, the biasing arrangement is arranged to capture energy when the support frame is moved into the proximal relationship with the base.

In an embodiment of the first aspect, the apparatus comprises two linkage arms.

In an embodiment of the first aspect, each of the two linkage arms includes at least one cross member.

In an embodiment of the first aspect, the cross members are arranged to connect to the biasing arrangement.

In an embodiment of the first aspect, the at least one linkage arm is rotatably connected to the support frame and the base.

In an embodiment of the first aspect, the biasing arrangement includes at least one resilient member arranged to maintain the base and the support frame in the spaced apart relationship.

In an embodiment of the first aspect, the resilient member is a torsion spring.

In an embodiment of the first aspect, the resilient member is a gas spring.

In an embodiment of the first aspect, the biasing arrangement includes at least one torsion spring and at least one gas spring arranged to cooperate to maintain the base and the support frame in the spaced apart relationship.

In an embodiment of the first aspect, the torsion spring is disposed adjacent to a connection connecting the base to the at least one linkage arm.

In an embodiment of the first aspect, the gas spring is disposed between the base and the at least one linkage arm.

In an embodiment of the first aspect, the apparatus further comprises at least one land arranged to engage to the bed.

In an embodiment of the first aspect, the at least one land is disposed on the support member.

In an embodiment of the first aspect, the at least one land is telescopically extendable from the support member to vary the width of the support member.

In an embodiment of the first aspect, the at least one land includes at least one aperture for engagement to the bed.

In an embodiment of the first aspect, the base includes at least one cross member.

In an embodiment of the first aspect, the support frame includes at least one cross member.

In an embodiment of the first aspect, the gas spring is disposed between the support frame and the at least one linkage arm.

In an embodiment of the first aspect, the gas spring is engaged to the at least one linkage arm at or near a midpoint of the at least one linkage arm.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

Figure 1:
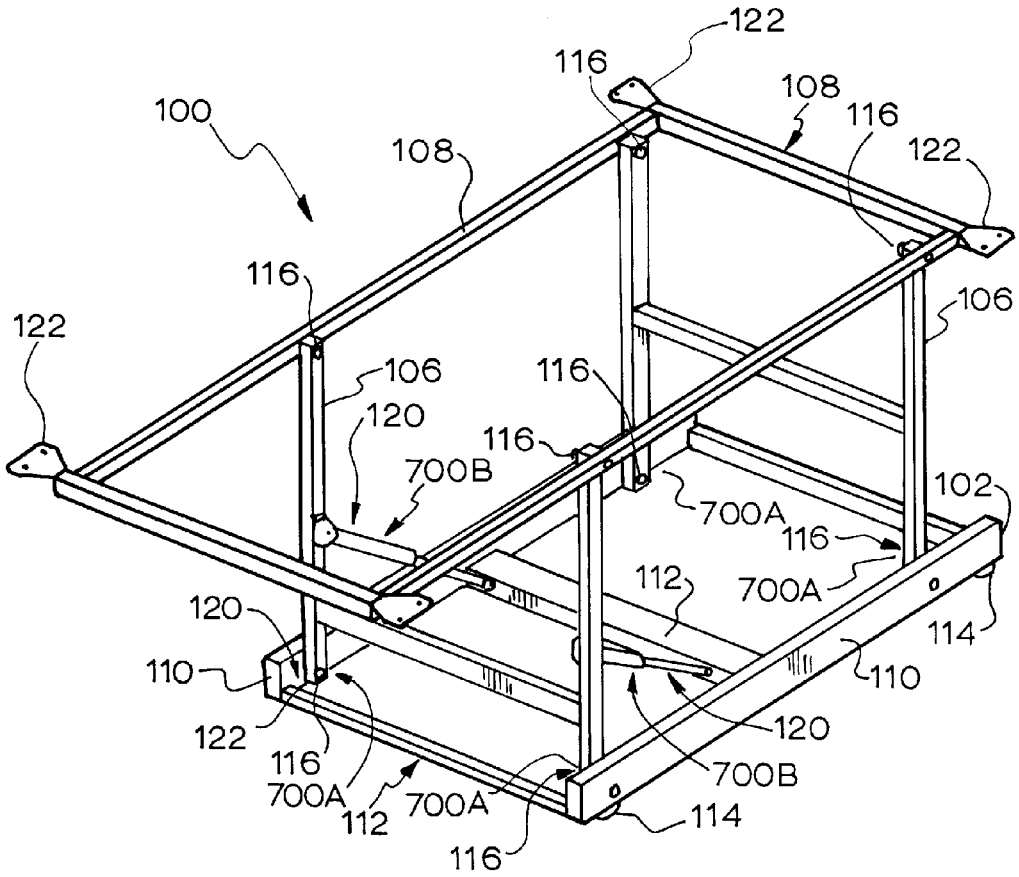
FIG. 1 is a perspective view of a bed lifting apparatus in an elevated position in accordance with one embodiment of the present invention.
Figure 2A:
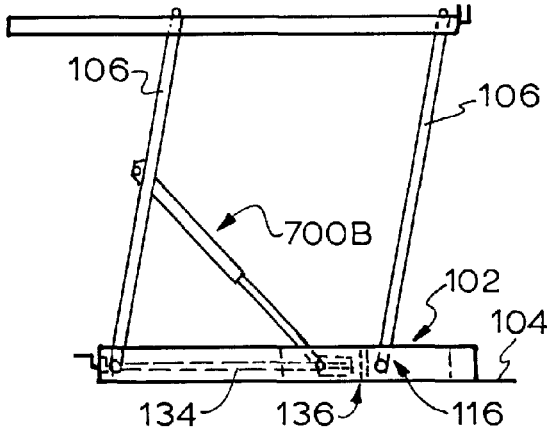
FIG. 2A is a side view of the bed lifting apparatus in an elevated position in accordance with a second embodiment of the invention.
Figure 2B:
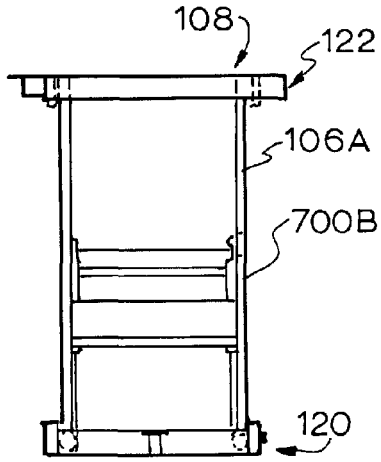
FIG. 2B is a front view of the bed lifting apparatus of FIG. 2A in an elevated position.
Figure 2C:
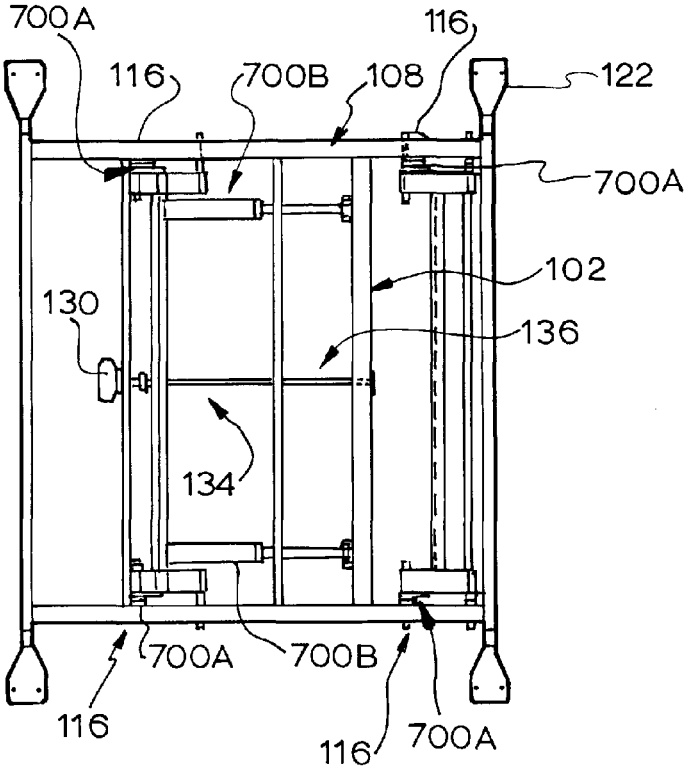
FIG. 2C is a top view of the bed lifting apparatus of FIG. 2A in an elevated position.

Referring to FIG. 1, there is provided a bed lifting apparatus 100 comprising a bed lifting apparatus comprising a base and a support frame connected by at least one linkage arm, the at least one linkage arm including at least one biasing arrangement arranged to maintain the base and the support frame in a spaced apart relationship, wherein, in use, when a bed is located on the support frame, the bed is maintained in a spaced apart relationship from a floor surface.

In this embodiment, the bed lifting apparatus comprises a base 102 arranged to rest on a ground or floor surface 104 of a room, resting area, campsite or vehicle. The base 102 is engaged to a plurality of linkage arms 106 which support a support frame 108 arranged to space apart or elevate above the base during use such that a bed 602 resting on the support frame 108 can also be spaced apart or elevated from the base 102.

In one example, the base 102 may include a rectangular structure made from a suitable material such as wood, plastic or metal. Preferably, tubular steel members 110 are wielded together to form the base structure 102 with cross members 112 provided therein to reinforce the rigidity and strength of the base 102. The base 102 may also include a plurality of legs 114 arranged to rest the base on the surface 104, although these legs 114 may be replaceable with castor wheel members (not shown) to allow the apparatus 100, and the bed which resting thereon during use, to be moved freely on the surface 104.

In this embodiment, the base 102 is engaged to a plurality of linkage arms 106 which are arranged to rotate about the base 102 and the support frame 108 such that the support frame 108 may be rotated from an lower position, which in this embodiment is where the support frame 108 is near or proximal to the base 102 to demonstrate a proximal relationship between the support frame 108 and the base 102, into an elevated position above the base 102. The elevated position may also be referred to as the spaced apart position in that the support frame 108 and the base 102 are in a spaced apart relationship. Preferably, each of the linkage arms 106 are rotatably engaged to each of the base 102 and the support frame 108 such that the arms are able to rotate about the base 102 whilst allowing the support frame 108 to rotate about the linkage arms 106 to move into the elevated position. In these embodiments, each of the arms are preferably engaged to the support frame 108 and the base 102 by a rotatable engagement 116, such as a bearing to allow rotation movement between the arms 106, base 102 and the support frame 108, whilst allowing the linkage arms 106 to support the support frame 108 and its load (e.g. the bed) above the base 102. Once the support frame 108 is elevated from the base 102 to lift the bed resting on the support frame 108 to an elevated position, which may be a suitable distance above the ground surface 104. Once in the elevated position, the mattress may be accessed at near waist height of a person whilst revealing the ground surface beneath the bed for cleaning or inspection.

Figure 7:
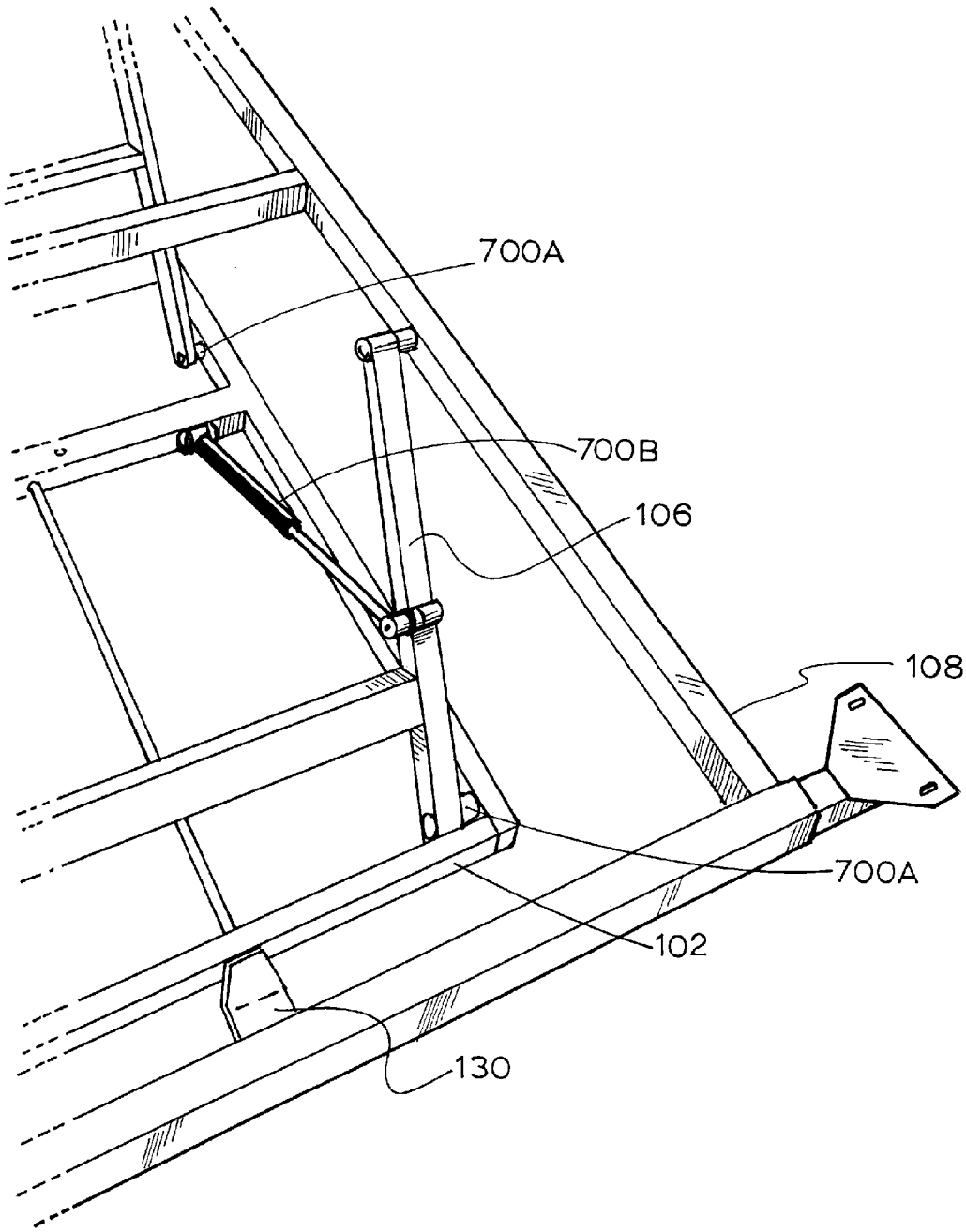
FIG. 7 is an illustration of an embodiment of the biasing arrangement of the bed lifting apparatus of FIG. 2A.

In addition to these rotatable engagements, a biasing arrangement 120 is incorporated to the linkage arm 106 to provide the lifting force necessary to elevate the support frame 108 and the bed resting on the support frame 108. Examples of the biasing arrangements 120 are further described below with reference to FIG. 7. In the embodiments referred to in FIGS. 1 to 7, the biasing arrangement 120 is arranged to maintain the elevated position (where there is a spaced apart relationship between the support member 108 and the base 102) of the apparatus 100 until pressure is applied against the biasing arrangement 120 to move the apparatus 100 into the lowered position (where there is a proximal relationship between the support member 108 and the base 102).

Preferably, the support frame 108 includes a plurality of lands 122. In one embodiment, the lands 122 are arranged to support or engage a bed resting on the support frame 108. As illustrated in FIGS. 1, 2A, 2B, 2C, 4 and 5, the lands may include at least one aperture for a fastener to be inserted through the lands to engage the bed. In alternative embodiments, the lands are adjustable and may be extended away or retracted into the frame 108. The adjustability of the lands 122 allows the support frame to support beds of varying width. This is particularly advantageous in that a single apparatus may be used for Single, King Single, Double, Queen, King or other sized beds with out the requirement to use a difference size support frame 108 for each different bed size.

The support frame 108 and adjustable lands may also be made from any suitable material, including plastic, timber, metal or ceramic. Preferably, the frame and lands are made of tubular steel or aluminum. The support frame 108 may also include a plurality of cross members, each arranged to provide additional rigidity and strength to the support frame 108. The lands 122 may also be constructed to telescopically extend and retract from the support frame 108 to extend or reduce the width of the support frame to accommodate differently sized beds.

With reference to FIG. 1, 2, 4A to 7, an example embodiment of the biasing arrangement 120 is shown. In this embodiment, the biasing arrangement 120 comprises a plurality of resilient members 700 to store potential energy when the apparatus 100 is in the lowered position, and when activated to move into the elevated position, the resilient members 700A, 700B are arranged to release the potential energy stored within each members 700A, 700B to elevate the support frame and the bed. In one example embodiment as shown in FIGS. 1, 2, 4A to 7, a plurality of torsion springs 700A are deployed between the base 102 and each of the linkage arms 106 adjacent to the rotation engagement 120 between each of the linkage arms 106 and the base 102. These torsion springs 700A are arranged to release potential energy in a rotational manner such that the linkage arms 106 are subjected to the released energy to thereby rotate from the base 102 to elevate the support frame 108.

As illustrated in the embodiment of FIGS. 1, 2, 4A to 7, in addition to the torsion springs 700A, gas springs 700B may also be deployed on two of the linkage arms 106. In this embodiment, the gas springs 700B, which are also known as gas struts, are arranged to engage a near central portion of two of the linkage arms 106 and to the near opposing portion of the base 102 by a plurality of rotatable engagements. By being engaged in this position with the linkage arms and the base 102, the gas springs 700B may complement the torsion springs 700A by releasing additional potential energy stored within the gas spring 700B to elevate the support member 108 from the base 102. These embodiments are advantageous in that in some embodiments where the torsion springs 700A are unable to release a sufficient amount of energy to maintain rotational movement of the linkage arms 106 for the elevation of the support frame 108, the gas springs 700B are able to complement the torsion springs 700A to complete the elevation movement of the support frame 108. This is particularly advantageous in that torsion spring 700A members may not be efficient in releasing potential energy when the spring 700A is near or adjacent to its initial position (lowered position) or final position (elevated position). In these positions, the gas springs 700B is able to delivery the additional potential energy to elevate the support frame 108 and bed engaged thereon.

Figure 3:
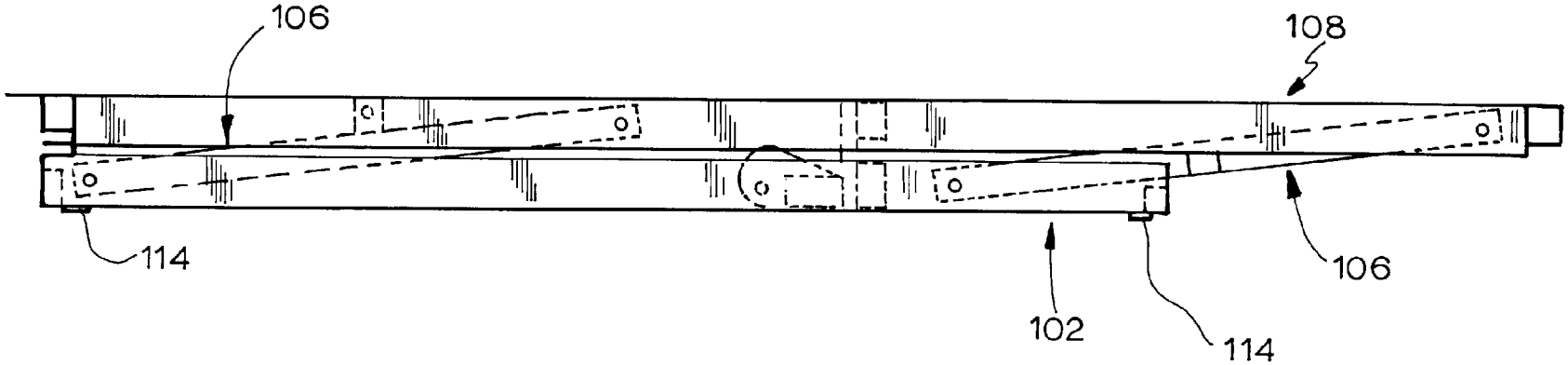
FIG. 3 is a side view of the bed lifting apparatus of FIG. 2A in a lowered position.
Figure 4A:
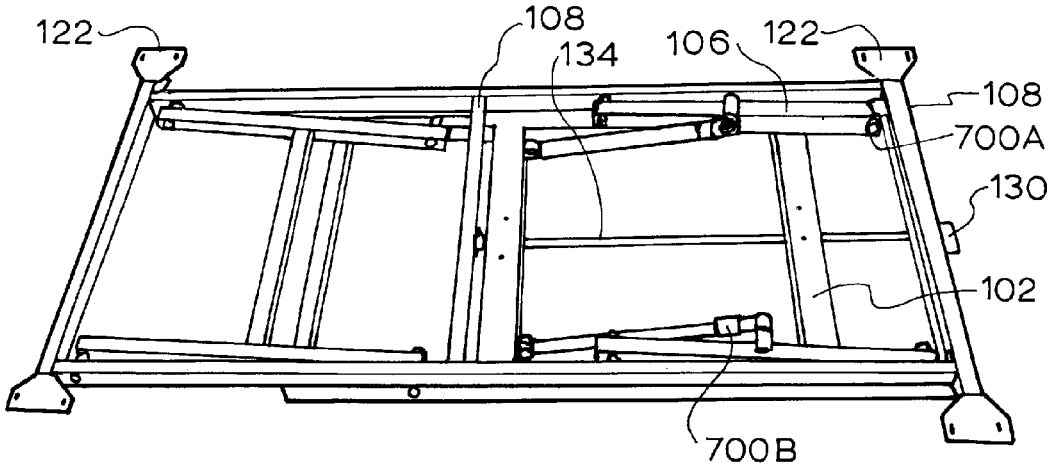
FIG. 4A and 4B are illustrations of the bed lifting apparatus of FIG. 2A in a lowered position and with one of the gas spring disengaged from the apparatus for illustration purposes.
Figure 4B:
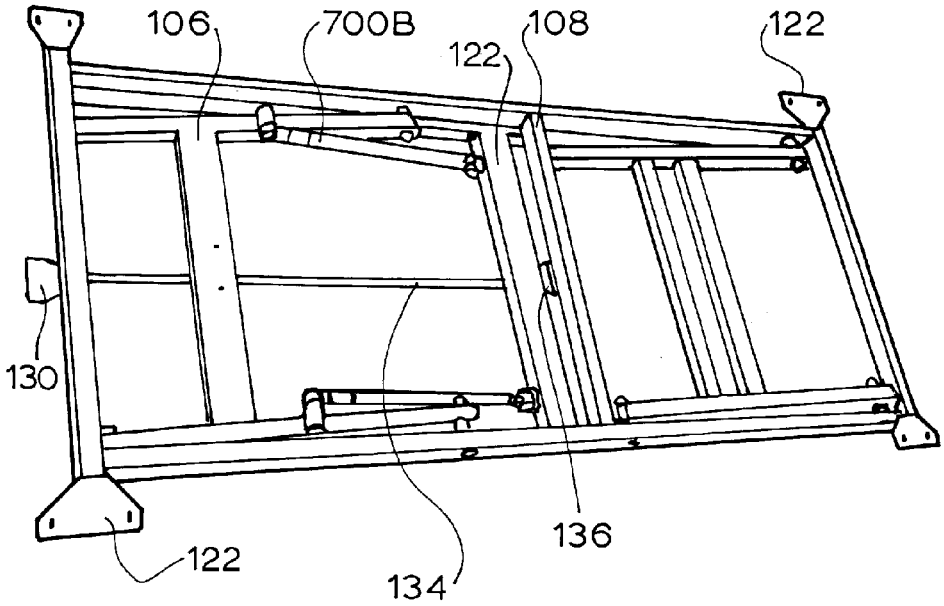
Figure 5A:
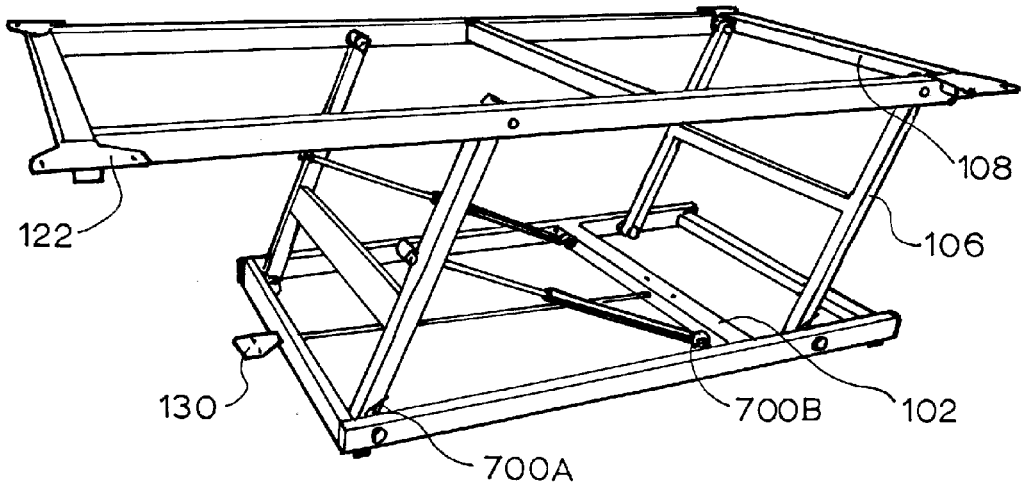
FIG. 5A and 5B are illustrations of the bed lifting apparatus of FIG. 2A in an elevated position.
Figure 5B:
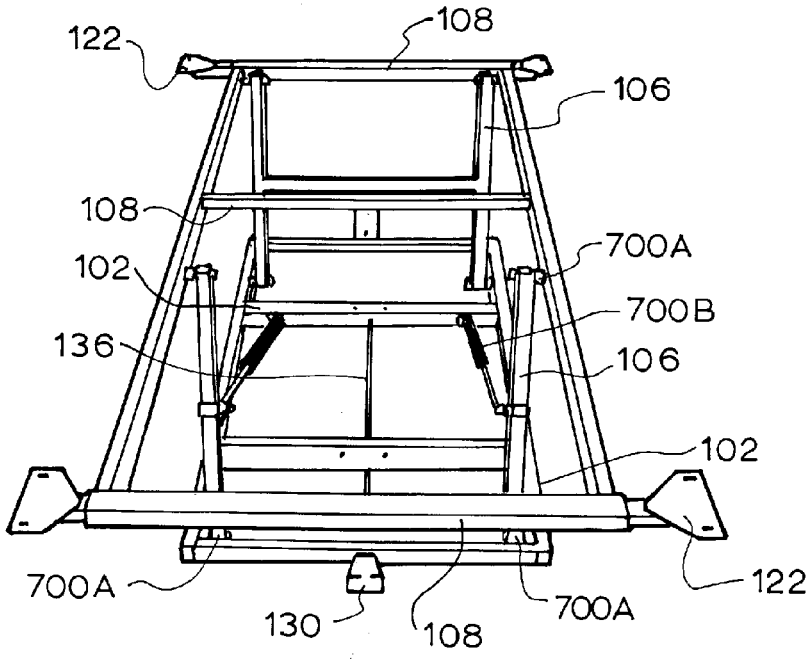
Figure 6A:
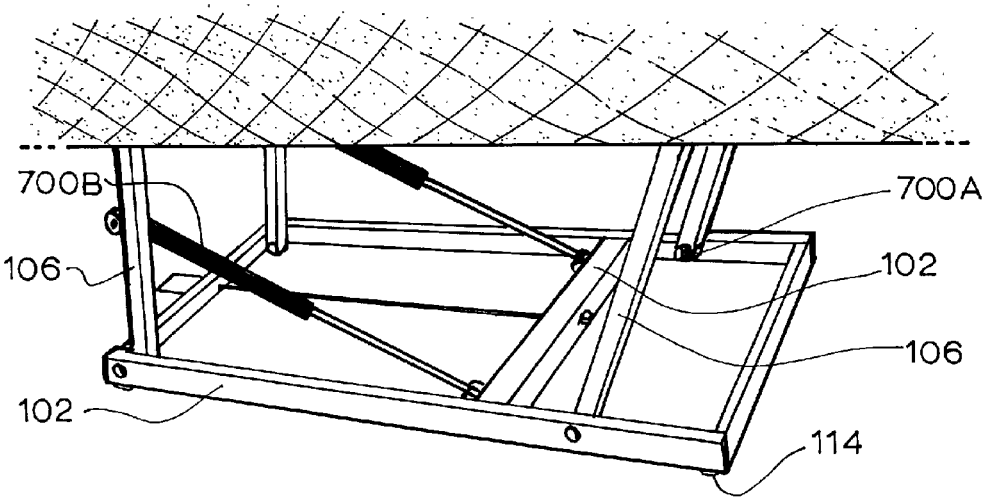
FIGS. 6A to 6C are illustrations of the bed lifting apparatus of FIG. 2A in use.
Figure 6B:
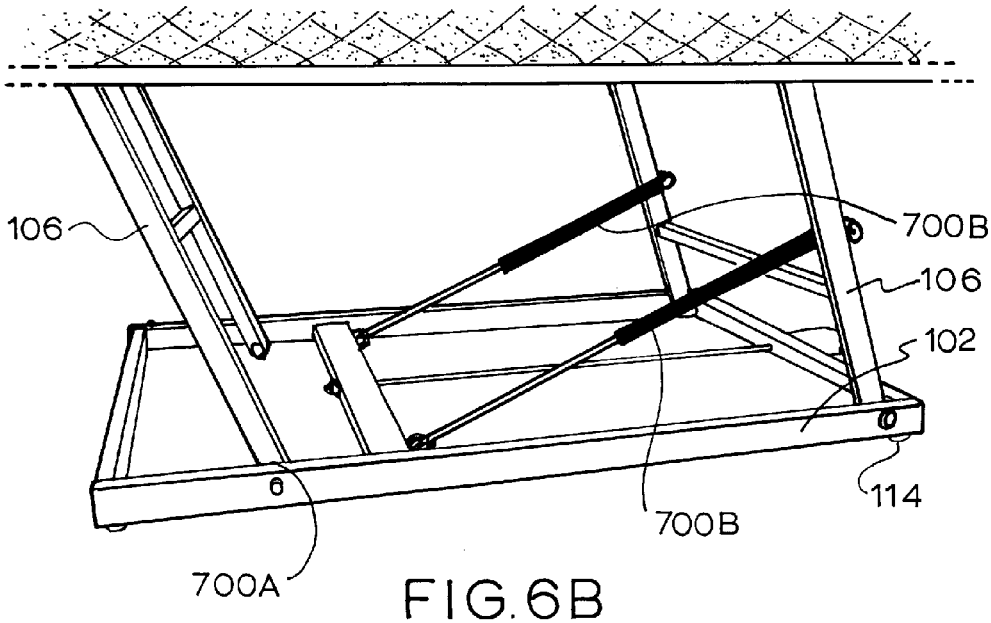
Figure 6C:
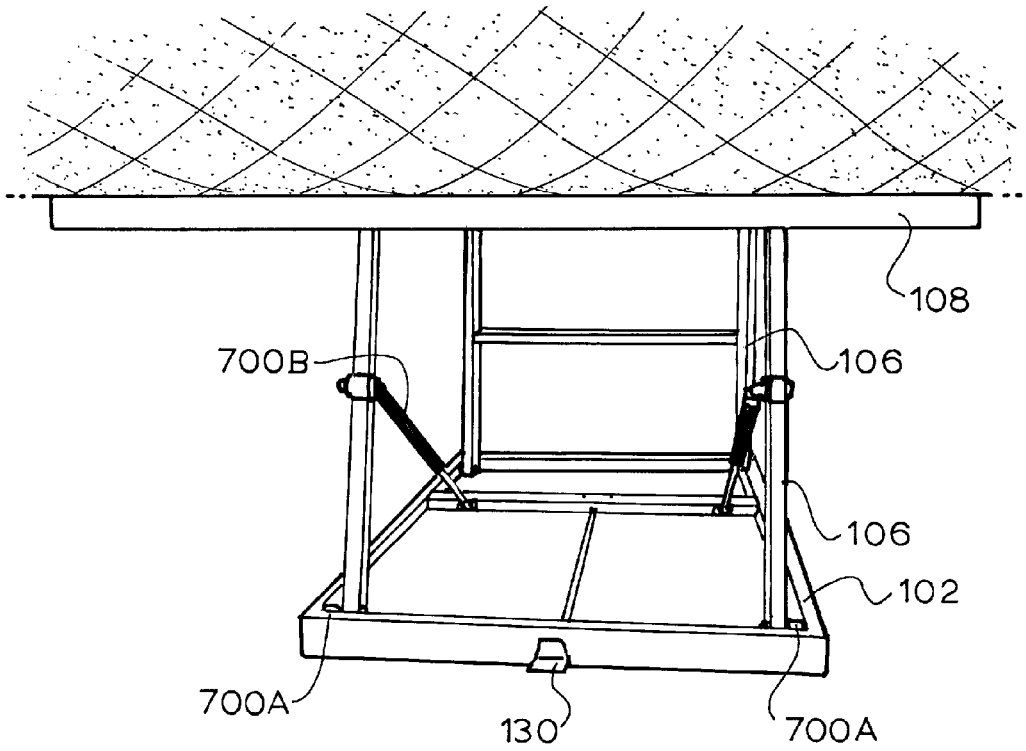

Once the apparatus 100 is in the elevated position and the worker has completed the preparation of the bed supported on the apparatus 100, the worker can simply apply a downwards force on the bed or support frame 108 to push the apparatus 100 from the elevated position as shown in FIGS. 1, 2A to 2C, 5A to 7 and into the lowered position as shown in FIGS. 3 to 4B. In doing so, the downwards force pushes the biasing arrangement 120 and its resilient members 700A and 700B into their initial position such that potential energy is restored within each of the resilient members 700A, 700B. The amount of downward force required to be applied by a worker to return the apparatus 100 from the elevated position and into the lowered position is compensated by the weight of the support frame 108, portions of the linkage arms 106, the bed and any bed fixtures on the bed.

Preferably, the resilient members 700A and 700B are specifically arranged to be suited to a particular sized and weight of a particular bed such that only a relatively small amount of energy is required to return the apparatus 100 back to its lowered position. In this way, the resilient members 700A and 700B may be selective replaced or adjusted based on the weight of the bed in which the apparatus is intended to support and elevate. For example, where the bed is expected to be approximately 60 to 70 kg (such as in a standard single bed with a bed base and mattress combination), the torsion springs used are of a rating of Gauge 1 or 2, whilst the gas springs have a rating of 40 to 60 Newtons.

With reference to FIGS. 2A to 7, there is shown embodiments of the apparatus 100 having an actuator 130 arranged to resist the movement of the support frame 108 or linkage arms 106 such that the potential energy stored within the resilient members 700A, 700B are not released until a user desires to elevate the bed. In this way, the actuator 130 may be used as a manner to control the elevation of apparatus 100. The actuator may be a locking mechanism controlled mechanically or electronically through a switch and relay system. Preferably, the actuator is a mechanical lock arranged to lock the linkage arms 106 or support frame 108 to the base 102 such that the support frame 108 is unable to elevate until the mechanical lock is unlocked.

In this embodiment, the apparatus 100 has a foot switch 132 arranged to actuate a spring loaded rod 134 which retracts a locking portion 136 arranged to lock the support frame 108 to the base 102 when the apparatus 100 is in the lowered position. Once the foot switch 132 is actuated, the rod 134 is retracted and thereby retracting the locking portion 136 away from a locking aperture in the support frame 108. Once unlocked, the support frame 108 and the engaged linkage arms 106 are free to rotate. At this point, the biasing arrangement 120 and its resilient members 700A, 700B releases energy to rotate the linkage arms 106 and thereby elevating the support frame 108, and with, the entire bed. When the apparatus 100 is returned to the lowered position, the locking portion 136 will proceed to lock the support frame 108 to the base 102, and thereby locking the apparatus in the lowered position until actuation by a user.

In operation, an apparatus 100 in a lowered position is placed underneath a bed. The bed may comprise a standard bed base with a mattress, or a "box bed" type which may include a timber, metal or plastic bed frame supporting a mattress. In any one of these beds, the bed may be secured to the apparatus by fasteners, such as screws, bolts, glue, Velcro etc to the lands 122 of the support frame 108. Once the apparatus 100 is properly secured to the bed, the bed may be supported by the apparatus 100, or its own legs, or a combination of both. In some examples, the bed may include its own individual support legs, such that when the apparatus 100 is not in use, the bed is supported by its own legs. In another example, the bed is completely supported by the apparatus 100 above the ground surface. In yet another example, both the legs of the bed and the apparatus 100 will support the bed in the lowered position.

When a user desires to elevate the bed to access the mattress from near waist height, or to access the areas under the bed for inspection or cleaning, the user may actuate the biasing arrangements 120 to elevate the bed. Once a user wishes to return the bed to the lowered position, the user may apply a light force on to the top of the bed to push the support frame 108 and linkage arms 106 into the lowered position. By returning the support frame to the lowered position, potential energy is restored within the resilient members 700A, 700B of the biasing arrangements 120. Preferably, the resilient members 700A, 700B are selected based on the weight of the bed such that the user need only apply a relative small amount of pressure to the bed to return the apparatus to the lowered position. Alternative, the user may simply sit on the bed with their weight to return the bed and the apparatus 100 back to the lowered position.

With reference to FIGS. 8A, 8B, 8C and 8D there is illustrated another embodiment of a bed lifting apparatus.

In this embodiment, the bed lifting apparatus 800 is similar to the embodiments of the apparatus as shown in FIGS. 1 to 7 in that the bed lifting apparatus 800 is also arranged to lift a bed above a ground surface.

The bed lifting apparatus 800 includes a base 802 and a support frame 804 connected by at least one linkage arm 806, the at least one linkage arm 806 including at least one biasing arrangement 820 arranged to maintain the base 802 and the support frame 808 in a spaced apart relationship, wherein, in use, when a bed is located on the support frame 808, the bed is maintained in a spaced apart relationship from a floor surface.

In this embodiment, the base 802 is engaged to a cross member 112 to form a rigid base structure. Preferably, the cross members 112 and the base 802 are made from tubular steel members which are welded together to form the base structure which, due to its rigid structure provides a load bearing support of the support frame 808, which in turn is arranged to receive a bed or other forms of furniture in which it is desired to be elevated from a surface. Preferably, as shown in FIGS. 8A, 8B, 8C and 9, the support frame 808 includes adjustable lands 805 which are arranged to telescope to and from the support frame so as to receive and support different bed widths.

In a similar structure to some embodiments of the apparatus illustrated in FIGS. 1 to 7, the base 802 includes a plurality of linkage arms 806 which are each arranged to rotate about the base 802. The each linkage arms 806 is in turn rotatably engaged with the support frame 808 so that the support frame 808 may be elevated into a position above the base 802 when the linkage arms 806 rotate relative to the base 802. This elevated position may be referred to as the spaced apart position in that the support frame 108 and the base 102 are in a spaced apart relationship.

Figure 8A:
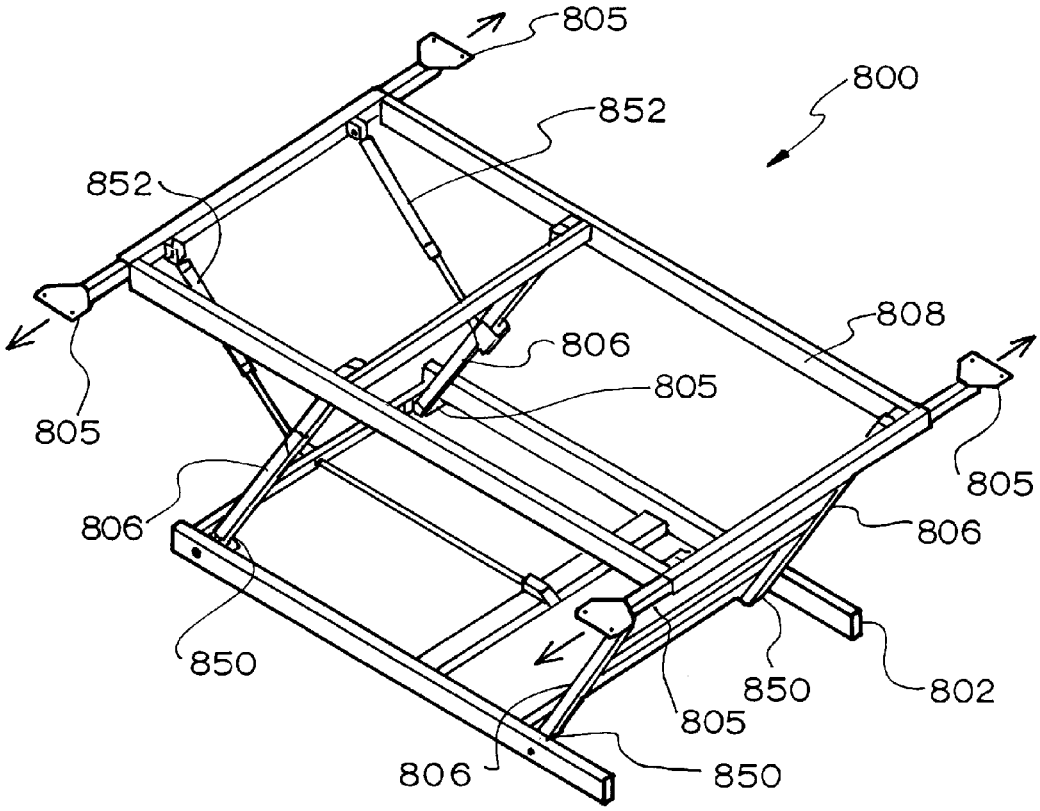
FIGS. 8A, 8B and 8C are illustrations of another embodiment of the bed lifting apparatus in an elevated position.
Figure 8B:
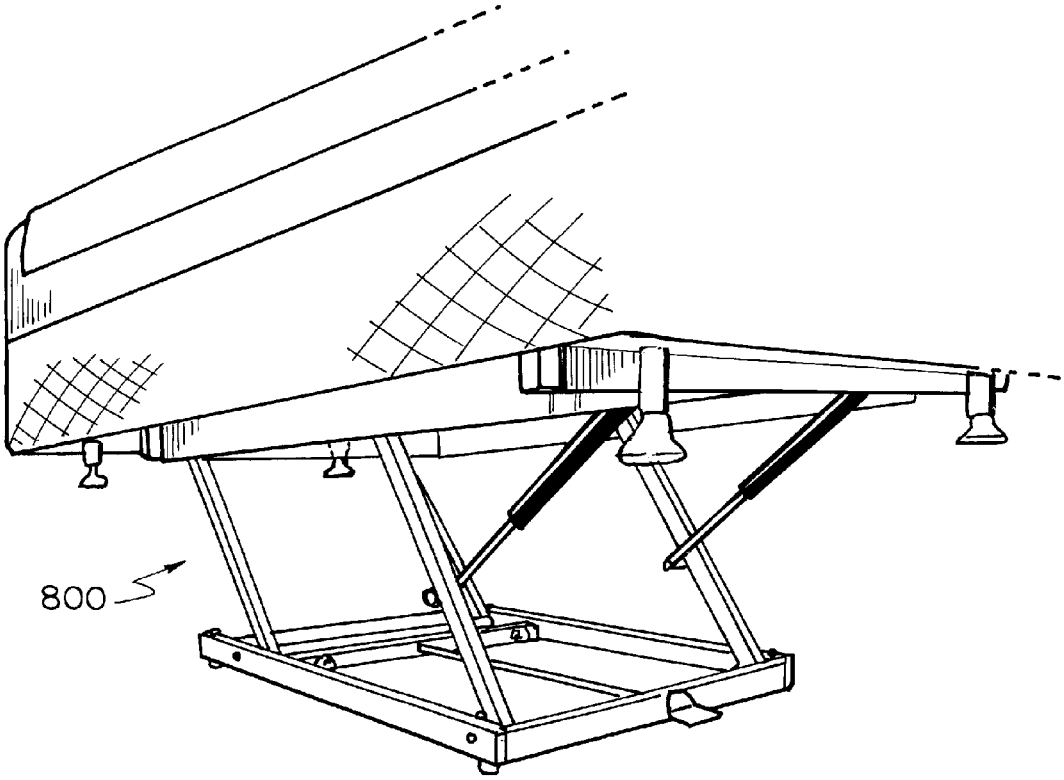
Figure 8C:
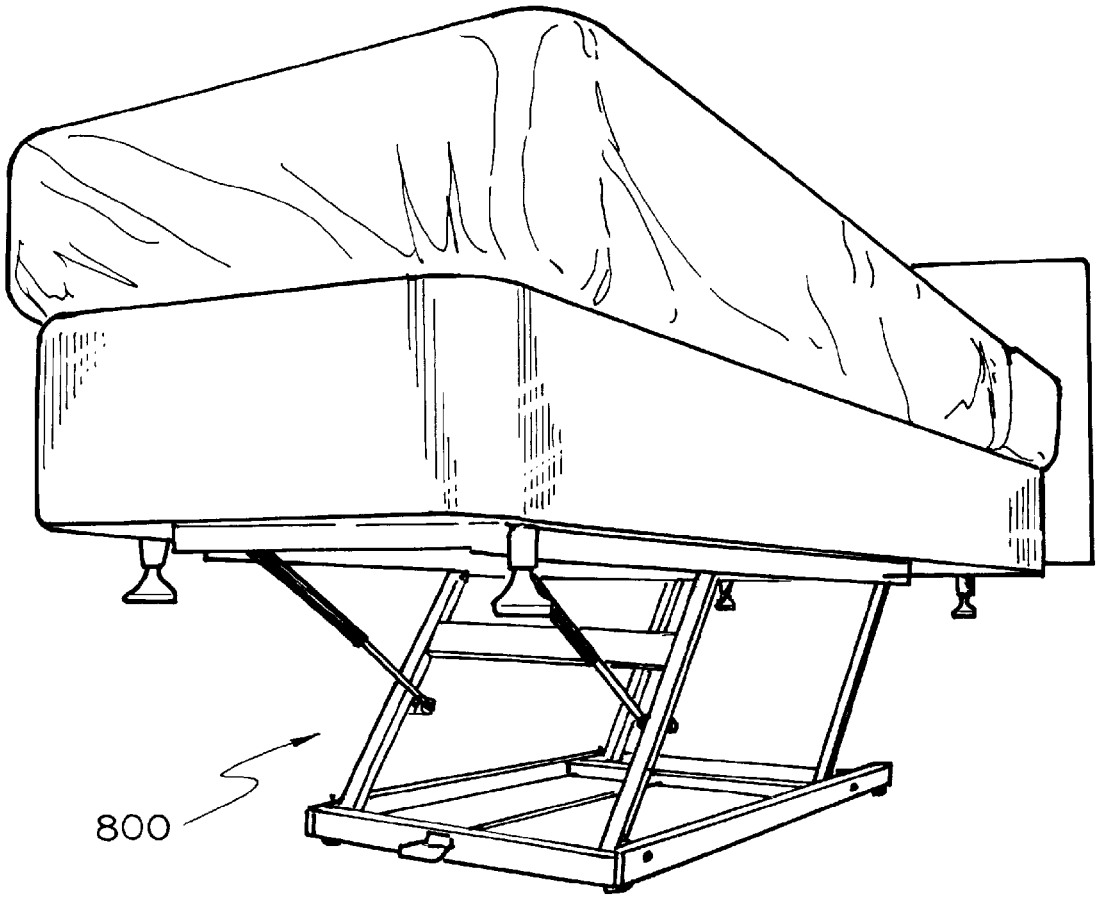
Figure 8D:
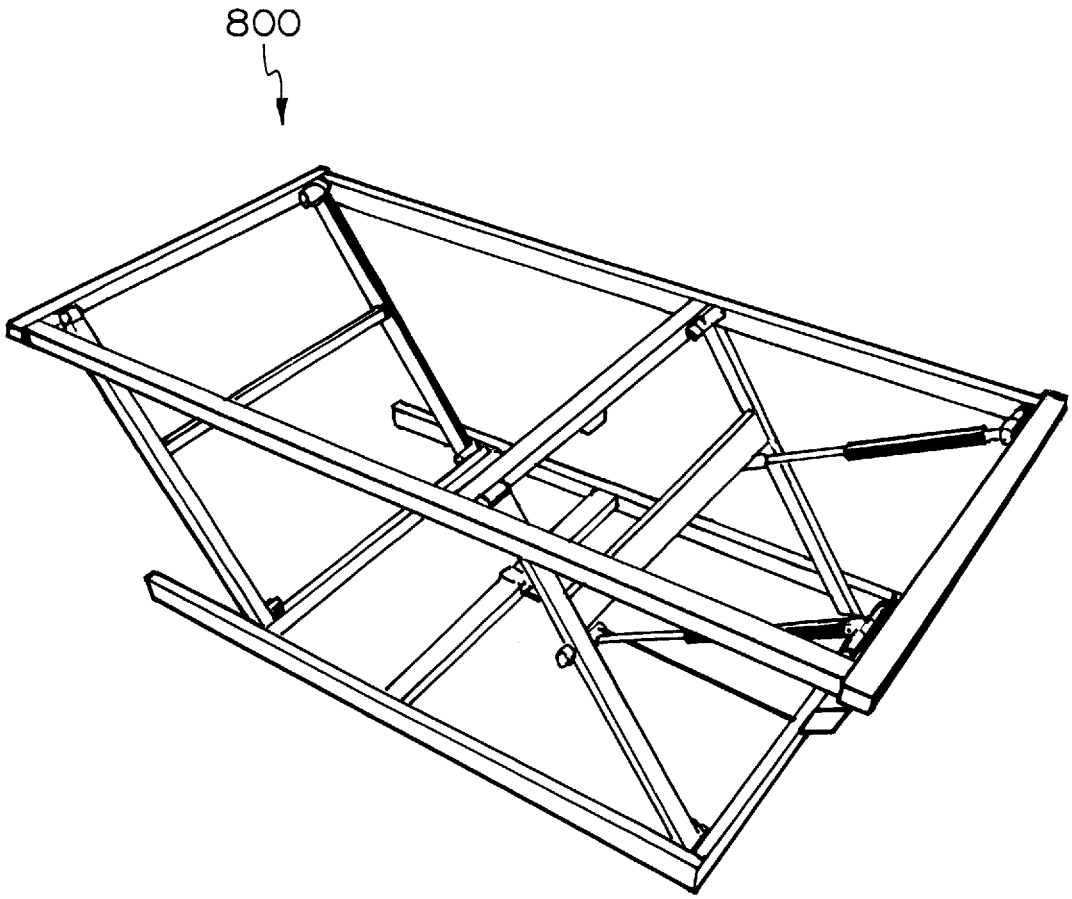
FIGS. 8D is an illustration of the bed lifting apparatus in FIGS. 8A, 8B and 8C without the adjustable lands.
Figure 9:
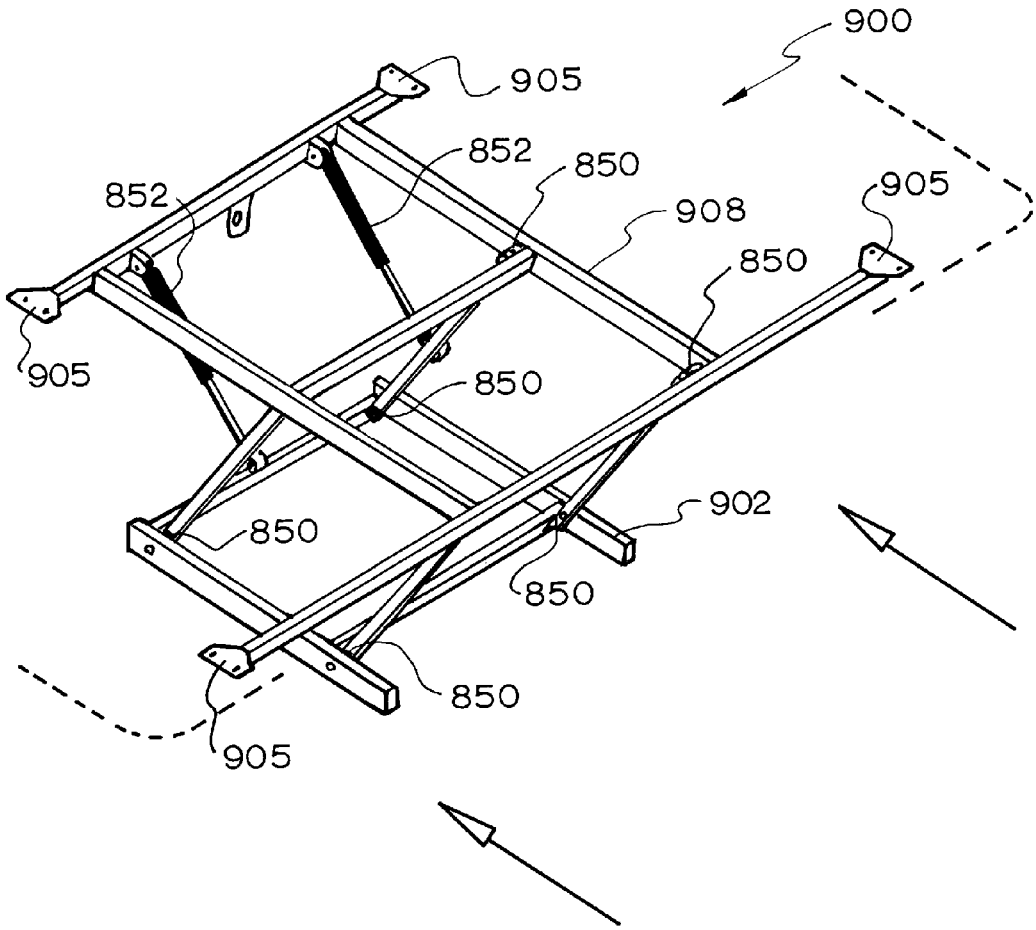
FIG. 9 is an illustration of another embodiment of the bed lifting apparatus in an elevated position.

As illustrated in FIGS. 8A to 9, the linkage arms 806 may include a biasing arrangement 820, which in this embodiment, comprises an arrangement of torsion springs and gas spring members. In the examples shown in FIGS. 8A to 9, the torsion springs 850 are disposed on each of the joints between the linkage arms 806 and the base 802 and the joints between the linkage arms 806 and the support frame 808. Preferably, the torsion springs 850 are arranged to store potential energy when the bed and the support frame 808 is in the lowered position, that is, when the support frame is at its most proximal position with the base 802 and the ground. Once actuated, the torsion springs 850 are arranged to release the potential energy in the form of rotational force, including torque, on the linkage arms 806 so that the support frame 808 and any load disposed thereon can be rotated into an elevated position.

As shown, in this embodiment, the biasing arrangement 820 also includes a pair of gas spring members 852, which may also be known as gas springs or gas struts. The gas spring members 852 may be engaged to the support frame 808 and the linkage arms 806. In this example, the gas spring members 852 are rotatably engaged to the support frame 808 and adjacent to a midpoint of a pair of linkage arms 806. Preferably, the gas springs 852, in a similar manner as to the torsion springs 850, store potential energy when the support member 808 is in the lowered position and when actuated, complement the torsions springs 850 in providing additional force to elevate the support member 808 with the load disposed thereon, particularly when the support member 802 is approaching or nearing the elevated position during the lifting process.

In some instances, these embodiments are advantageous in that the gas springs 852 apply a push/pull action directly on or with the support frame 808. This in turn allows a user to return the elevated support frame 808 and its load thereon to the lowered position by applying mainly a pushing down force on the bed, resulting in subsequently less horizontal force required to return the support frame 808 and bed to the lowered position. This will thereby render the process of returning the bed to the lowered position to be an easier process as a user can simply push downwards or sit on the bed without having to push substantially in the horizontal direction to return the elevated bed to the lowered position.

With reference to FIG. 9, there is illustrated an alternative embodiment of the bed lifting apparatus. In this embodiment, the bed lifting apparatus 900 is arranged to receive a bed from a lengthwise edge such that the base member 902 and the support frame 908 are substantially perpendicular to the lengthwise edges of the bed.

Preferably, the apparatus 900 is similar in construction to any of the apparatus shown in FIGS. 1 to 8C but with the base 902 and support frame 908 being dimensioned to substantially support the width of a bed. The apparatus 900 may also include adjustable lands 905 which are arranged to telescopically extend to support the length of the bed. In one example embodiment, the length of the support frame 908 is approximately 890 mm whilst each of the lands 905 may be extended 900 mm away from the support frame 908. These dimensions are suitable for the apparatus 900 to support a single bed on its lengthwise edge.

This embodiment is advantageous in that in rooms where a bed is placed in a relative small cavity where it would not be possible or convenient to access the bed from the width end of the bed, the apparatus 900 can be used to elevate the bed from the lengthwise side of the bed.

The embodiments of the invention may be advantageous in that a bed may be lifted into a near waist height position to allow a worker to service and prepared the bed whilst reducing the requirement of the worker to bend down or work in awkward and uncomfortable positions. In light of these advantageous, the risk of injury to workers and the amount of time required to prepare a bed may be reduced. In some embodiments, the apparatus 100 operates entirely on the self contained mechanical arrangements, and therefore, does not require cabling to provide electric power or control signals.

In some alternative instances, to ease installation, it may be more advantageous to secure the support frame to the bed when the apparatus is in an elevated position.

In some examples, the bed may include its own individual support legs, such that when the apparatus is not in use, the bed is supported by its own legs. In another example, the bed is completed supported by the apparatus above the ground surface. In yet another example, both the legs of the bed and the apparatus will support the bed in the lowered position.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A bed lifting apparatus comprising:

a base and a support frame connected by at least one linkage arm; and the at least one linkage arm including at least one biasing arrangement arranged to maintain the base and the support frame in a spaced apart relationship;

wherein, in use, when a bed is located on the support frame, the bed is maintained in a spaced apart relationship from a floor surface; and wherein the biasing arrangement includes at least one resilient member arranged to maintain the base and the support frame in the spaced apart relationship; and wherein the resilient member includes at least one torsion spring and at least one gas spring arranged to cooperate to maintain the base and the support frame in the spaced apart relationship; and wherein the at least one torsion spring is arranged to release potential energy in a rotational manner to thereby effect rotation of the at least one linkage arm.

2. A bed lifting apparatus in accordance with claim 1, wherein the support frame is arranged to move into a proximal relationship with the base when a force is applied in opposition to the biasing arrangement.

3. A bed lifting apparatus in accordance with claim 2, wherein movement is effected when the force is applied on the bed or support frame in a direction towards the base.

4. A bed lifting apparatus in accordance with claim 2, further comprising a locking arrangement arranged to lock the support frame in the proximal relationship with the base.

5. A bed lifting apparatus in accordance with claim 4, wherein the locking arrangement is disposed on the base.

6. A bed lifting apparatus in accordance with claim 4, wherein the locking arrangement is arranged to penetrate an aperture of the support frame to lock the support frame with the base.

7. A bed lifting apparatus in accordance with claim 4, wherein the locking arrangement is in communication with an actuator arranged to extend the locking arrangement into and retract the locking arrangement from the aperture of the support frame.

8. A bed lifting apparatus in accordance with claim 7, wherein the actuator includes a foot operated switch.

9. A bed lifting apparatus in accordance with claim 1, wherein the biasing arrangement is arranged to cooperate with the at least one linkage arm to maintain the support frame in a spaced apart relationship with the base.

10. A bed lifting apparatus in accordance with claim 1, wherein the biasing arrangement is arranged to capture energy when the support frame is moved into the proximal relationship with the base.

11. A bed lifting apparatus in accordance with claim 1 comprising two linkage arms.

12. A bed lifting apparatus in accordance with claim 1, wherein each of the two linkage arms includes at least one cross member.

13. A bed lifting apparatus in accordance with claim 12, wherein the cross members are arranged to connect to the biasing arrangement.

14. A bed lifting apparatus in accordance with claim 1, wherein the at least one linkage arm is rotatably connected to the support frame and the base, wherein the at least one torsion spring is arranged to release potential energy in a rotational manner to thereby effect rotation of the at least one linkage arm relative to the base, and wherein rotation of the at least one linkage arm relative to the base elevates the support frame.

15. A bed lifting apparatus in accordance with claim 1, wherein the torsion spring is disposed adjacent to a connection connecting the base to the at least one linkage arm.

16. A bed lifting apparatus in accordance with claim 1, wherein the gas spring is disposed between the base and the at least one linkage arm.

17. A bed lifting apparatus in accordance with claim 1, wherein the gas spring is disposed between the support frame and the at least one linkage arm.

18. A bed lifting apparatus in accordance with claim 17, wherein the gas spring is engaged to the at least one linkage arm at or near a midpoint of the at least one linkage arm.

19. A bed lifting apparatus in accordance with claim 1, further comprising at least one land arranged to engage to the bed.

20. A bed lifting apparatus in accordance with claim 19, wherein the at least one land is disposed on the support member.

21. A bed lifting apparatus in accordance with claim 19, wherein the at least one land is telescopically extendable from the support member to vary the width of the support member.

22. A bed lifting apparatus in accordance with claim 19, wherein the at least one land includes at least one aperture for engagement to the bed.

23. A bed lifting apparatus in accordance with claim 1, wherein the base includes at least one cross member.

24. A bed lifting apparatus in accordance with claim 1, wherein the support frame includes at least one cross member.

25. A bed lifting apparatus comprising:

a base and a support frame connected by at least one linkage arm; and the at least one linkage arm including at least one biasing arrangement arranged to maintain the base and the support frame in a spaced apart relationship;

wherein, in use, when a bed is located on the support frame, the bed is maintained in a spaced apart relationship from a floor surface; and wherein the biasing arrangement includes at least one torsion spring and at least one gas spring arranged to cooperate to maintain the base and the support frame in the spaced apart relationship; and wherein the at least one torsion spring is arranged to release potential energy in a rotational manner to thereby effect rotation of the at least one linkage arm.

26. A bed lifting apparatus comprising:

a base and a support frame connected by at least one linkage arm; and the at least one linkage arm including at least one biasing arrangement arranged to maintain the base and the support frame in a spaced apart relationship;

wherein, in use, when a bed is located on the support frame, the bed is maintained in a spaced apart relationship from a floor surface; and wherein the biasing arrangement includes at least one resilient member arranged to maintain the base and the support frame in the spaced apart relationship;

wherein the resilient member includes at least one torsion spring and at least one gas spring arranged to cooperate to maintain the base and the support frame in the spaced apart relationship; and wherein the torsion spring is disposed adjacent to a connection connecting the base to the at least one linkage arm.

* * * * *